United States Patent [19]

Matsui

[11] 4,423,586

[45] Jan. 3, 1984

[54] PNEUMATIC YARN SPLICING DEVICE

[75] Inventor: Isamu Matsui, Kyoto, Japan

[73] Assignee: Mutata Kikai Kabushiki Kaisha, Kyoto, Japan

[21] Appl. No.: 437,276

[22] Filed: Oct. 28, 1982

[30] Foreign Application Priority Data

Oct. 29, 1981 [JP] Japan ..... 56-161347[U]

[51] Int. Cl.[3] ..... D01H 15/00

[52] U.S. Cl. ..... 57/22; 57/261

[58] Field of Search ..... 57/22, 23, 261

[56] References Cited

U.S. PATENT DOCUMENTS

| | | | |
|---|---|---|---|
| 4,217,749 | 8/1980 | Rohner et al. | 57/261 |
| 4,246,744 | 1/1981 | Matsui et al. | 57/22 |
| 4,263,775 | 4/1981 | Mima | 57/22 |
| 4,322,943 | 4/1982 | Rohner et al. | 57/22 X |
| 4,344,277 | 8/1982 | Rohner et al. | 57/22 |

*Primary Examiner*—Donald Watkins

*Attorney, Agent, or Firm*—Spensley, Horn, Jubas & Lubitz

[57] ABSTRACT

A pneumatic yarn splicing device comprises a bracket, a yarn splicing member mounted on the bracket and having a pair of side faces and a yarn splicing hole extending transversely between the side faces, the yarn splicing member including an air ejection nozzle for ejecting a compressed air flow into the yarn splicing hole, and a pair of yarn presser levers pivotably mounted with respect to the bracket and each having on a distal end thereof a step defined by a first portion close to one of the side faces and a second portion spaced therefrom, the yarn splicing hole being partly closable by the first portion when the yarn presser levers are angularly moved to bring the step into confronting relation to the yarn splicing hole.

7 Claims, 4 Drawing Figures

PNEUMATIC YARN SPLICING DEVICE

BACKGROUND OF THE INVENTION

The present invention relates to a pneumatic yarn splicing device.

Known pneumatic yarn splicing devices have a yarn splicing member with a yarn splicing hole extending transversely between its side faces. Yarn ends to be spliced together are untwisted and introduced into the yarn splicing hole in which the yarn ends are twisted and twined into a joined yarn by a stream of compressed air flowing into the yarn splicing hole. The stream ejected against the yarn ends however tends to swirl in the yarn splicing hole and partly flow out of open ends of the yarn splicing hole, preventing the yarn ends from being joined together effectively. To cope with this problem, there have been used control plates spaced a slight distance from the open ends of the yarn splicing hole. The control plates are effective to prevent an unwanted loss of air from the yarn splicing hole. Such devices are disclosed, for example, in U.S. Pat. No. 4,263,775 and U.S. patent application Ser. No. 359,947. However, they keep the yarn splicing hole partly closed and hence interfere with introduction of new yarn ends into the yarn splicing hole in preparation for splicing such yarn ends.

SUMMARY OF THE INVENTION

It is an object of the present invention to provide a pneumatic yarn splicing device including a pair of yarn presser levers for pressing yarn ends to be spliced together at the open ends of a yarn splicing hole, each of the yarn presser levers having means for preventing an excessive amount of compressed air from flowing out of the yarn splicing hole without interferring with introduction of the yarn ends into the yarn splicing hole.

According to the present invention, a pneumatic yarn splicing device comprises a bracket, a yarn splicing member mounted on the bracket and having a pair of side faces and a yarn splicing hole extending transversely between the side faces, the yarn splicing member including an air ejection nozzle for ejecting a compressed air flow into the yarn splicing hole, and a pair of yarn presser levers pivotably mounted with respect to the bracket and each having on a distal end thereof a step defined by a first portion close to one of the side faces and a second portion spaced therefrom, the yarn splicing hole being partly closable by the first portion when the yarn presser levers are angularly moved to bring the step into confronting relation to the yarn splicing hole.

When yarn ends to be spliced together are untwisted and introduced into the yarn splicing hole in overlapped relation, they are twined and twisted by the compressed air flowing from the nozzle into the yarn splicing hole. The compressed air is prevented from escaping in an undue amount from the yarn splicing hole by the first portions of the yarn presser levers by which the yarn splicing hole is partly closed.

The above and other objects, features and advantages of the present invention will become more apparent from the following description when taken in conjunction with the accompanying drawings in which a preferred embodiment of the present invention is shown by way of illustrative example.

DETAILED DESCRIPTION

Figure 1:
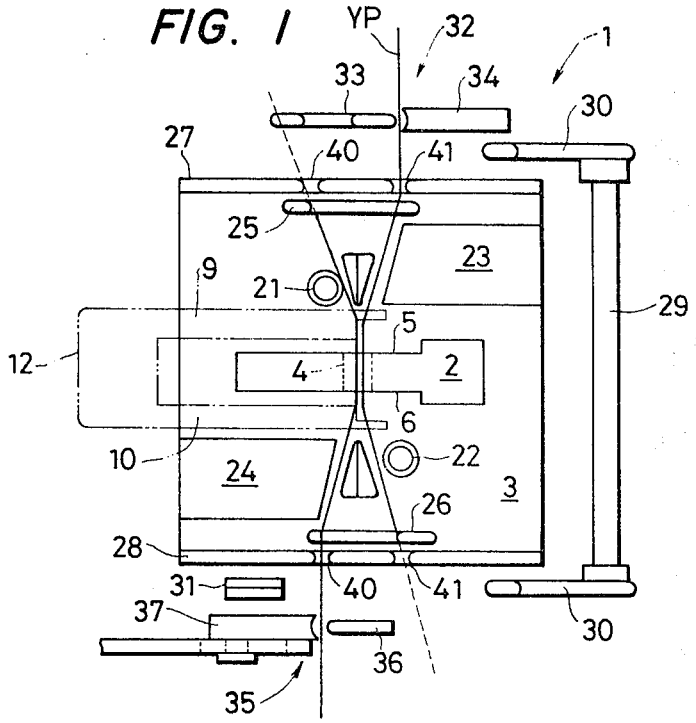
FIG. 1 is a front elevational view of a pneumatic yarn splicing device according to the present invention.
Figure 2:
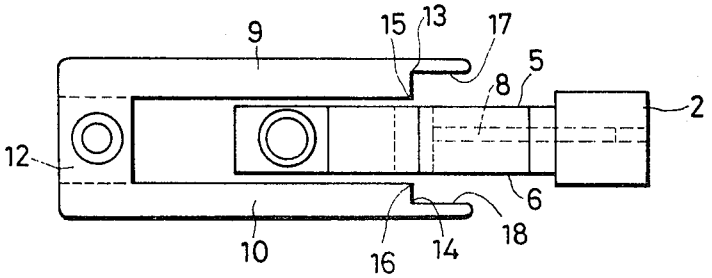
FIG. 2 is a front elevational view of a yarn splicing member in the pneumatic yarn splicing device shown in FIG. 1.
Figure 3:
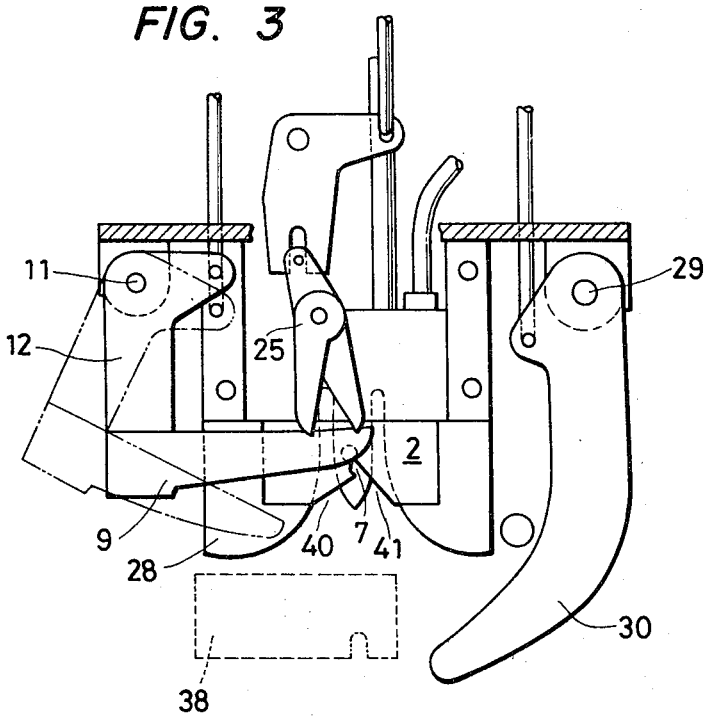
FIG. 3 is a plan view of the pneumatic yarn splicing device.
Figure 4:
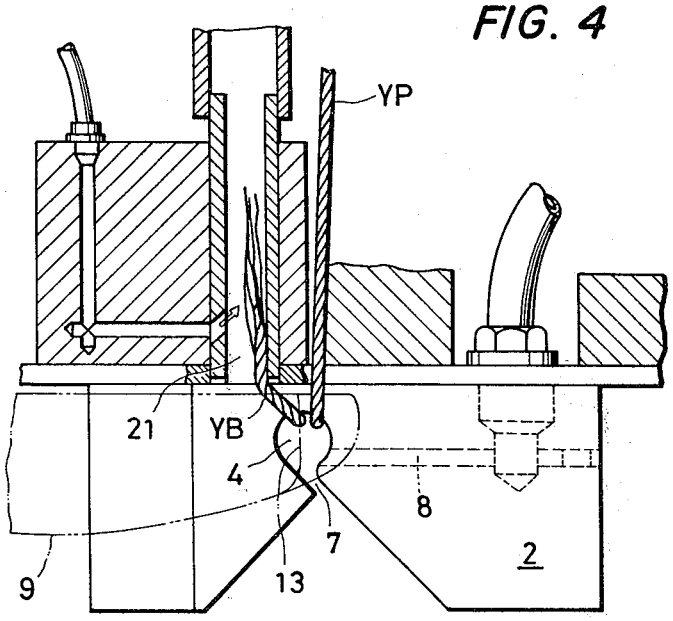
FIG. 4 is a plan view partly in section showing the yarn splicing member.

As shown in FIG. 1, a pneumatic yarn splicing device 1 has a yarn splicing member 2 located substantially centrally on the device 1 and fixed to a bracket 3. The yarn splicing member 2 has a central yarn splicing hole 4 of a cylindrical shape extending laterally therethrough between side faces 5, 6 of the yarn splicing member 2. As best shown in FIG. 4, the yarn splicing hole 4 includes a slit 7 extending along the full length thereof in a direction tangential to the yarn splicing hole 4 for allowing a yarn Y to pass therethrough into the yarn splicing hole 4. An air ejection nozzle 8 is defined in the yarn splicing member 2 and opens into the yarn splicing hole 4. A pair of yarn presser levers 9, 10 (FIG. 2) are disposed in confronting relation to the side faces 5, 6, respectively, and cover the open ends of the yarn splicing hole 4. The yarn presser levers 9, 10 are mounted on a swing arm 12 pivotably supported on a shaft 11 (FIG. 3). When the swing arm 12 is angularly moved, the swing levers 9, 10 nip at their distal ends the yarn Y introduced in the yarn splicing hole 4 in cooperation with the bracket 3. The distal ends of the yarn presser levers 9, 10 have steps 13, 14, respectively, which define portions 15, 16 adjacent to the side faces 5, 6, respectively, of the yarn splicing member 2 and portions 17, 18 spaced from the side faces 5, 6, respectively. When the yarn presser levers 9, 10 nip the yarn Y, the steps 13, 14 face the open ends of the yarn splicing hole 4 while transversing the latter to close the open ends thereof.

The portions 15, 16 of the steps 13, 14 serve to position a yarn end YP on the package side and a yarn end YB on the bobbin side which are inserted in the yarn splicing hole 4, at a location in which the yarn ends YP. YB will securely be twined around each other at an initial stage when air is ejected out of the air ejection nozzle 8. The step portions 15, 16 also serve to control the amount of air flowing out of the open ends of the yarn splicing hole 4 for preventing the yarn ends YP, YB from being forced out of the yarn splicing hole 4, so that a sightly yarn connection will be produced by a desired swirling flow of air. The step portions 15, 16 are spaced from the side faces 5, 6 by a distance determined to prevent the yarn ends YP, YB from being forced out of the slit 7 on the flow of compressed air which hits sidewalls of the yarn presser levers 9, 10 and is directed toward the slit 7, thus controlling the amount of air flowing out of the slit 7. Air is supplied to the air ejection nozzle 8 from a source of air (not shown) through a conduit coupled thereto.

As shown in FIG. 1, the pneumatic yarn splicing device 1 also comprises a pair of control nozzles 21, 22, a pair of yarn guides 23, 24, a pair of yarn cutters 25, 26, and a pair of fork guides 27, 28, disposed respectively on both sides of the yarn splicing hole 5 in the yarn splicing member 2. A pair of yarn gathering levers 30, 30 are fixed to upper and lower ends of a support shaft 29 for pivotable movement therearound, the yarn gathering levers 30, 30 being positioned alongside of the yarn splicing member 2. One of the yarn gathering lever 30 is engageable with a stopper 31. A pair of cramp units 32, 35 comprise swing levers 33, 36 and stoppers 34, 37, respectively, for clamping the yarn ends YP, YB, respectively.

Operation of the pneumatic yarn splicing device 1 is as follows: When a detector 38 (FIG. 3) detects that no yarn is running due to a breakage in a yarn being rewound or an empty bobbin, a takeup drum is stopped for yarn splicing operation. A pair of package and bobbin suction arms (not shown) attract the yarn ends YP, YB, respectively, and turn around to introduce the yarn ends YP, YB into the yarn splicing device 1. More specifically, the yarn end YP is carried by the package suction arm and travels along a curved path to a position outside of the yarn splicing device 1. Then, the swing lever 33 is actuated to sandwich the yarn end YP between itself and the stopper 34, and the detector 38 checks the yarn end YP. Thereafter, the yarn end YB is carried by the suction arm at the bobbin side and moves to a position outside of the yarn splicing device 1. The yarn end YB is then clamped between the swing lever 36 and the stopper 37.

After the operation of the suction arms has been completed, the yarn gathering levers 30, 30 are angularly moved about the support shaft 29 to guide the yarn end YB, YP respectively into guide slots 40, 41 in the fork guides 27, 28 and then into the yarn splicing hole 4 through the slit 7.

Then, the yarn ends are severed by the yarn cutters 25, 26 at positions spaced from the clamp units 32, 35 on the package and bobbin sides, respectively, as shown in FIG. 1.

More specifically, the yarn ends YB, YP are cut off when they are clamped by the clamp units 32, 35 and the swing levers 30, 30 are turned clockwise about the support shaft 29. At this time, the yarn presser lever 9, 10 have been turned clockwise about a rod 42. The yarn ends YB, YP are attracted to the control nozzles 21, 22, and at the same time or substantially at the same time the yarn gathering levers 30, 30 are moved away from the yarn Y. The yarn ends YB, YP are untwisted by compressed air injected into the control nozzles 21, 22 until they are untwisted to a degree suitable for yarn splicing.

After the yarn ends YB, YP have been untwisted by the control nozzles 21, 22, the latter stop their suction operation. Simultaneously or substantially simultaneously, the yarn gathering levers 30, 30 are actuated again to guide the yarn ends YB, YP until they are turned into abutment against the stopper 31, whereupon the yarn presser levers 9, 10 are operated to move into engagement with the bracket 3 while guiding the yarn ends YB, YP. One of the yarn presser levers 9, 10 at which the yarn Y is untwisted by compressed air ejected from the air ejection nozzle 8, grips the yarn ends YB, YP to prevent them from being untwisted. The other yarn presser lever simply presses the yarn ends YB, YP to position them without gripping them as the compressed air serves to twist the yarn ends YB, YP on the side of the other yarn presser lever.

The yarn ends YB, YP as they are drawn in the control nozzles 21, 22 by the yarn gathering levers 30, 30 and the yarn presser levers 9, 10 are introduced into the yarn splicing hole 4 and positioned therein in overlapping relation at end portions to be spliced together.

The yarn ends YB, YP as they are drawn out of the control nozzles 21, 22 by turning movement of the yarn gathering levers 30, 30 are guided by the steps 13, 14 of the yarn presser levers 9, 10, respectively, and positioned on an inner peripheral surface of the yarn splicing hole 4 by side edges of the steps 13, 14 and the step portions 15, 16. Thus, the yarn ends YB, YP are set in the yarn splicing hole 4 with their end portions to be joined being held together in overlapped relationship.

With the yarn ends YB, YP thus located in the yarn splicing hole 4, they are spliced together by the action of compressed air ejected from the air ejection nozzle 8. More specifically, fibers of the yarn ends are twined together by the air ejected out of the air ejection nozzle 8, and then turned around to twist the twined yarn ends and also cause yarn fibers to twine on opposite sides of the twisted yarn portion. As the control nozzles no longer have a suction effect on the yarn ends, the yarn ends are twined around completely for a desired yarn splicing without producing any edgy protrusions as the yarn ends undergo no unwanted resistance.

According to the present invention, the amount of air flowing out of the open ends of the yarn splicing hole is regulated by the step portions 15, 16 of the yarn presser levers arranged close to the opening of the yarn splicing hole so that fibers of the yarn ends to be spliced are more desirably twined together by the action of compressed air stream within the yarn splicing hole.

After the yarn ends have been spliced together, the yarn gathering levers 30, 30 and the yarn presser levers 9, 10 are moved away from the yarn ends YB, YP, which are then drawn out through the slit 7 in the yarn splicing member 2. The joined yarn is then rewound again.

With the arrangement of the present invention, the yarn ends are twined and twisted together by the air flow from the air ejection nozzle in the yarn splicing hole, while the yarn ends in the yarn splicing hole are positionally guided by the steps on the yarn presser levers for the utmost ease with which the yarn ends can be twisted. The steps of the yarn presser levers have portions close to the side faces of the yarn splicing member and other portions spaced therefrom, a structure which can control the amount of air flowing out of the slit from the yarn splicing hole so that there is no danger for the yarn ends to be forced out of the yarn splicing hole on such an air flow.

Although a certain preferred embodiment has been shown and described, it should be understood that many changes and modifications may be made therein without departing from the scope of the appended claim.

What is claimed is:

1. A pneumatic yarn splicing device comprising:

a bracket;

a yarn splicing member mounted on said bracket and having a pair of side faces and a yarn splicing hole extending transversely between said side faces, said yarn splicing member including an air ejection nozzle for ejecting a compressed air flow into said yarn splicing hole; and a pair of yarn presser levers pivotably mounted with respect to said bracket and each having a first portion for controlling the amount of air flowing out of the open ends of the yarn splicing hole and a second portion for nipping the yarn introduced in the yarn splicing hole in cooperation with the bracket.

2. A pneumatic yarn splicing device as claimed in claim 1, wherein said each yarn presser lever has on a distal end thereof a step defined by the first portion close to one of the side faces and the second portion spaced therefrom, said yarn splicing hole being partly closeable by said first portion when said yarn presser levers are angularly moved to bring said step into confronting relation to said yarn splicing hole.

3. A pneumatic yarn splicing device as claimed in claim 2, wherein said step portion are spaced from the side faces by a distance determined to prevent the yarn ends from being forced out of a slit of said yarn splicing hole on the flow of compressed air.

4. A pneumatic yarn splicing device as claimed in claim 3, wherein said yarn presser levers are disposed so that said one of the yarn presser levers at which the yarn is untwisted by the compressed air grips the yarn ends to prevent them from being untwisted while the other yarn presser lever simply press the yarn ends to position them without gripping them.

5. A pneumatic yarn splicing device as claimed in claim 1, wherein a pair of control nozzles, a pair of yarn guides, a pair of yarn cutters and a pair of fork guides are disposed respectively on both sides of the yarn splicing hole and the yarn presser levers.

6. A pneumatic yarn splicing device as claimed in claim 5, wherein a pair of yarn gathering levers fixed to upper and lower ends of a support shaft for pivotably movement therearound are positioned alongside of said yarn splicing member.

7. A pneumatic yarn splicing device as claimed in claim 6, wherein a pair of clamp units comprising swing levers and stoppers are further provided on both outsides of said yarn gathering levers.

* * * * *